US010471742B2

(12) United States Patent
Baterna

(10) Patent No.: US 10,471,742 B2
(45) Date of Patent: Nov. 12, 2019

(54) DUAL NIP RELEASE MECHANISM

(71) Applicant: Memjet Technology Limited, Dublin (IE)

(72) Inventor: Dan Baterna, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 15/993,494

(22) Filed: May 30, 2018

(65) Prior Publication Data

US 2018/0345684 A1 Dec. 6, 2018

Related U.S. Application Data

(60) Provisional application No. 62/515,353, filed on Jun. 5, 2017.

(51) Int. Cl.

| | |
|---|---|
| ***B65H 5/06*** | (2006.01) |
| ***B41J 11/00*** | (2006.01) |
| ***B41J 11/14*** | (2006.01) |
| ***B65H 29/12*** | (2006.01) |
| ***B41J 13/02*** | (2006.01) |
| ***B65H 5/38*** | (2006.01) |
| *B41J 11/44* | (2006.01) |

(52) U.S. Cl.

CPC ..... *B41J 11/006* (2013.01); *B41J 11/14* (2013.01); *B41J 13/025* (2013.01); *B65H 5/062* (2013.01); *B65H 5/38* (2013.01); *B65H 29/12* (2013.01); *B65H 29/125* (2013.01); *B41J 11/44* (2013.01); *B65H 2404/144* (2013.01); *B65H 2404/1421* (2013.01); *B65H 2404/1442* (2013.01); *B65H 2404/611* (2013.01); *B65H 2407/20* (2013.01); *B65H 2601/11* (2013.01)

(58) Field of Classification Search

CPC .... B65H 5/062; B65H 5/06; B65H 2404/144; B65H 2404/1421; B65H 2404/152; B65H 2404/1521; B65H 2601/11; B65H 2402/412; B65H 29/125; B65H 29/145; G03G 21/1638

See application file for complete search history.

(56) References Cited

U.S. PATENT DOCUMENTS 6,145,828 A * 11/2000 Arai ..... G03G 15/231 271/186
6,854,843 B2 * 2/2005 Anami ..... B41J 13/0063 271/273

FOREIGN PATENT DOCUMENTS

JP 2000289881 A * 10/2000

* cited by examiner

*Primary Examiner* — Luis A Gonzalez
(74) *Attorney, Agent, or Firm* — Cooley LLP

(57) ABSTRACT

A dual nip release mechanism includes: a rigid actuator body including a tail portion with a handle and a pivotally-mounted head portion having a nose member extending therefrom; a rocker arm pivotally mounted about a rocker arm shaft, the rocker arm having a proximal end for engagement with part of the nose member and a distal end engaged with a first shaft; and legs hingedly connected to the tail portion, each leg having a foot engaged with a second shaft and a heel for camming engagement with a fixed plate. During use, actuation of the handle causes simultaneous movement of the first and second shafts from a nip closed position to a nip open position via pivoting of the rocker arm and simultaneous camming engagement of the heel with the fixed plate.

19 Claims, 8 Drawing Sheets

DUAL NIP RELEASE MECHANISM

CROSS-REFERENCE TO RELATED APPLICATIONS

This application claims priority under 35 U.S.C. § 119(e) to U.S. Provisional Patent Application Ser. No. 62/515,353, entitled DUAL NIP RELEASE MECHANISM, filed on Jun. 5, 2017, the disclosures of each of which are incorporated by reference in their entirety for all purposes.

FIELD OF THE INVENTION

This invention relates to a dual nip release mechanism for a printer. It has been developed primarily for facilitating clearance of paper jams.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

Paper jams are a perennial problem in sheet-fed printers. In a sheet-fed printer, a media feed mechanism typically has an array of roller assemblies and sheets of print media (e.g. paper) are handed off from upstream nips to downstream nips along a media feed path. Small misalignments or variations in speed can cause paper to jam and buckle between rollers, and printing must be stopped until the jam has been cleared. Paper jams are frustrating for users and typically require manual intervention to clear the jam. The printer housing must be opened, the area of the jam identified and the jammed paper pulled from the printer. Invariably, the paper sheet is jammed in the nip of a roller assembly and it is usually necessary to release the nip so that the paper can be pulled easily from the printer. Various mechanisms exist for releasing nips in printers to facilitate clearance of paper jams.

Most printers have a series of roller assemblies upstream of a print zone and these roller assemblies are a common source of paper jams. For example, a de-skew roller assembly may be positioned upstream of a drive roller assembly, and paper jams may occur in the de-skew roller nip, the drive roller nip or both. In prior art systems, each roller nip has a dedicated nip release mechanism. However, it is inconvenient for users to operate separate nip release mechanisms when the source of the paper jam may not be known.

It would be desirable to simplify the procedure for clearing paper jams in printers. It would be particularly desirable to provide a nip release mechanism, which users can operate to release paper from more than one roller nip.

SUMMARY OF THE INVENTION

In a first aspect, there is provided a dual nip release mechanism for a printer comprising:

a rigid actuator body including a tail portion having a handle for user actuation and a pivotally-mounted head portion having a nose member extending therefrom;

a rocker arm pivotally mounted about a rocker arm shaft, the rocker arm having a proximal end for engagement with part of the nose member and a distal end engaged with a first shaft; and one or more legs hingedly connected to the tail portion, each leg having a foot engaged with a second shaft and a heel for camming engagement with a fixed plate, wherein, during use, actuation of the handle causes simultaneous movement of the first and second shafts from a nip closed position to a nip open position via pivoting of the rocker arm and simultaneous camming engagement of the heel with the fixed plate.

The dual nip release mechanism according to the first aspect advantageously facilitates clearance of paper jams by enabling users to manually open two nips associated with the first and second shafts simultaneously.

Preferably, each foot is configured for cradling the second shaft. In some embodiments, the foot is configured as an open-ended slot for receiving the second shaft.

Preferably, each leg is hingedly connected to the tail portion via a connecting arm.

Preferably, the connecting arm has a first end pivotally coupled to the tail portion and a second end pivotally coupled to a respective leg.

Preferably, each leg has a hip portion defining an arcuate guide slot and each connecting arm has a fixed guide pin projecting outwardly therefrom, each guide pin being slidingly received in a respective guide slot.

Preferably, the guide pin and guide slot together define an overcenter mechanism for locking the dual nip release mechanism in a nip open position.

Preferably, each guide slot has an inner guide wall and an outer guide wall, the inner guide wall having a resilient first end portion for locking the guide pin in the nip open position.

Preferably, the first end portion includes a cam lever for locking the guide pin in the nip open position.

Preferably, the hip portion comprises a spring for urging the cam lever against the guide pin.

Preferably, the second shaft is biased towards a complementary second shaft.

Preferably, the second shaft comprises one or more rotatable second rollers, each second roller having an associated nip in the nip closed position.

Preferably, the proximal end of the rocker arm comprises a cam follower surface for camming engagement with a cam surface of the nose member.

Preferably, the first shaft is rotatably received within one or more bearings at the distal end of the rocker arm.

Preferably, the rocker arm is biased towards the nip closed position.

In one embodiment, the dual nip release mechanism comprises a plurality of rocker arms, wherein the head portion comprises a plurality of nose members and each rocker arm is engagable with at least one respective nose member.

In one embodiment, the first shaft is part of a drive roller assembly and the second shaft is part of a de-skew roller assembly.

Preferably, upwards movement of the handle causes upwards movement of the first and second shafts from a nip closed position to a nip open position.

In a second aspect, there is provided a printer comprising:

a first nip associated with a first shaft;

a second nip associated with a second shaft; and a dual nip release mechanism as described hereinabove.

As used herein, the term "printer" refers to any printing device for marking print media, such as conventional desktop printers, label printers, duplicators, copiers and the like. In one embodiment, the printer is a sheet-fed printing device.

As used herein, the term "mounted" includes both direct mounting and indirect mounting via an intervening part.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
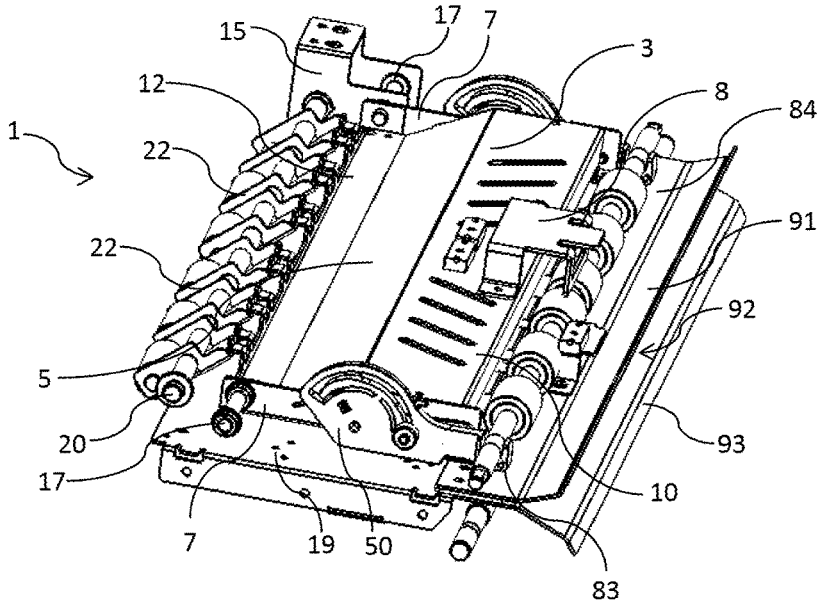
FIG. 1 is a top rear perspective of a dual nip release mechanism in a nip closed position.
Figure 2:
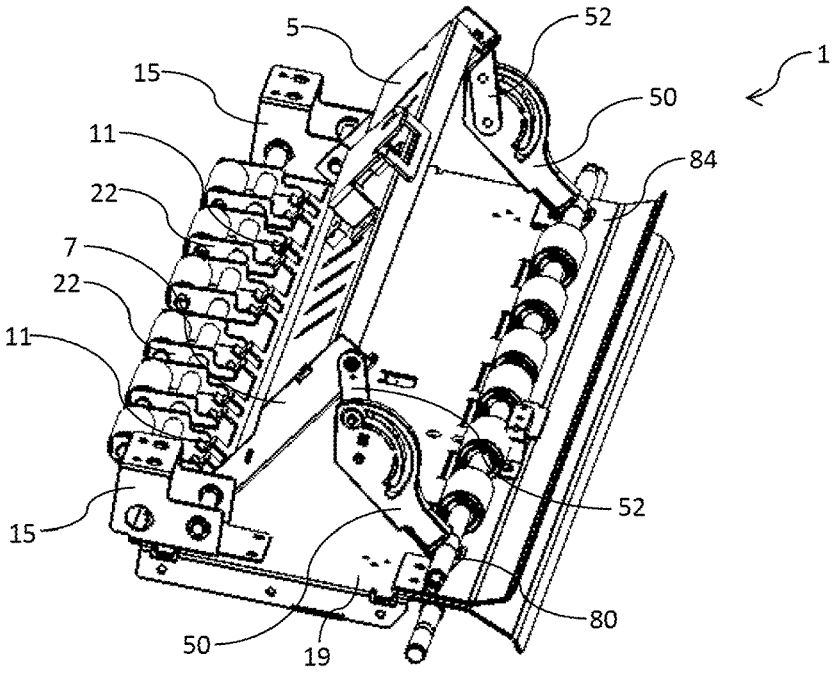
FIG. 2 is a top rear perspective of the dual nip release mechanism in a nip open position.
Figure 3:
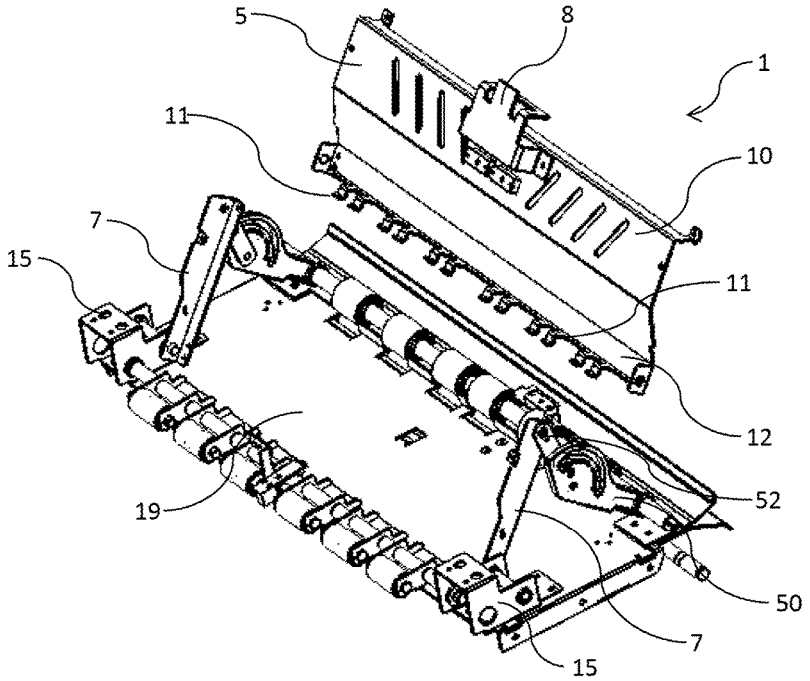
FIG. 3 is a partially exploded top front perspective of the dual nip release mechanism in the nip open position.

Referring initially to FIGS. 1 to 3, there is shown a dual nip release mechanism 1 comprising a rigid actuator body 3 having a profiled body member 5 fixedly mounted between a pair of side brackets 7. A user-operable handle 8 is fastened to a tail portion 10 of the body member 5 and a plurality of nose members 11 protrude from an opposite head portion 12 of the body member.

Each side bracket 7 is pivotally mounted to a corresponding side mounting 15 via a respective trunnion pin 17, which extends outwardly from each side bracket. The trunnion pins 17 are pivotally mounted to the side mountings 15, which are, in turn, fixedly mounted to a main chassis 19 supporting the dual nip release mechanism 1. Each pivotally-mounted side bracket 7 forms part of a three-part folding hinge mechanism, which will be described in further detail below.

In FIG. 3, the body member 5 has been removed from the side brackets 7 to show the separate components of the actuator body 3 more clearly; and in FIG. 1 one of the side mountings 15 has been removed to reveal one of the trunnion pins 17 and a rocker arm shaft 20, which is also supported between the side mountings.

Figure 11:
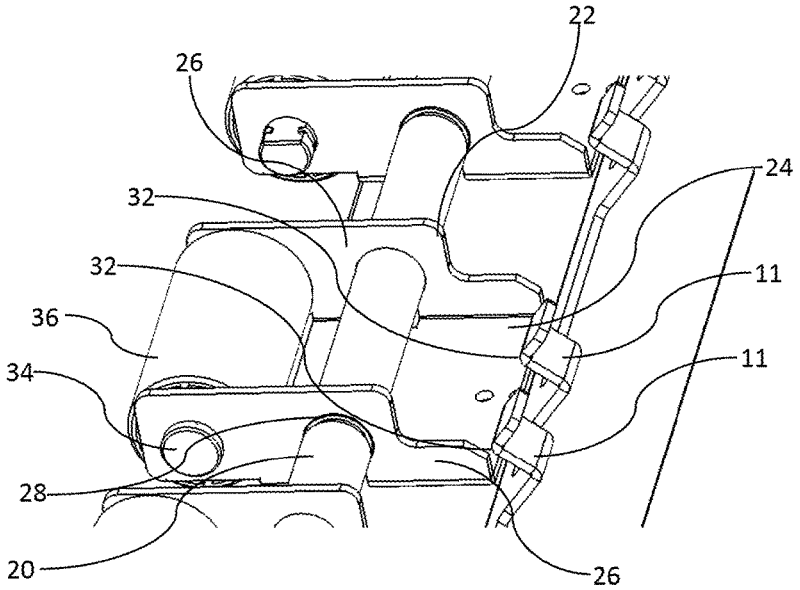
FIG. 11 is a magnified view of a rocker arm and nose member in the nip closed position.
Figure 12:
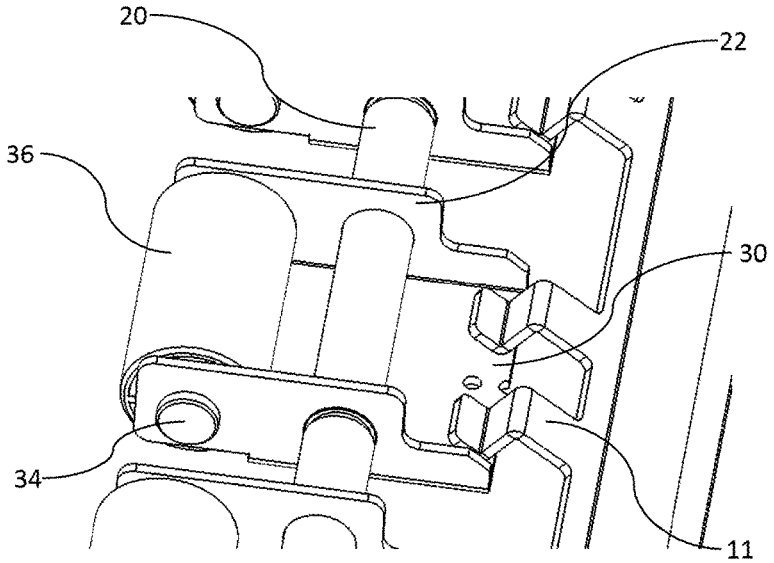
FIG. 12 is a magnified view of the rocker arm and nose member in the nip open position.

The rocker arm shaft 20 supports a plurality of rocker arms 22, which are commonly pivotally mounted along a length of the rocker arm shaft. Referring now to FIGS. 11 and 12, each rocker arm 22 comprises a rocker base plate 24 and a pair of rocker side plates 26 extending upwardly therefrom. The rocker side plates 26 each define a rocker bearing 28 for receiving the rocker arm shaft 22. The rocker arm shaft 20 defines a pivot axis of the rocker arms 22 parallel with a pivot axis of the actuator body 3.

The rocker arm 22 has a proximal end and a distal end at either side of the rocker arm shaft 20. The proximal end of the rocker arm 22 is defined as an end nearest the nose members 11 and comprises a cam follower surface 30 for camming engagement with corresponding nose cams 32 of a pair of nose members. In the embodiment shown, each nose member 11 includes an L-shaped member having a bent region defining the nose cam 32. However, it will be appreciated that any suitable cam surface may be used to define the nose cam 32. It will be further appreciated that any number of nose members 11 may be employed for engagement with cam follower surface 30 of the rocker arm 22.

The distal end of the rocker arm 22 is defined as an end furthest from the nose members 11 and is provided with a first shaft 34 rotatably mounted between opposed distal ends of the rocker side plates 26. The first shaft 34 has a first roller 36 fixedly mounted thereto for rotation therewith. From the foregoing, it will be appreciated that pivoting motion of each rocker arm 22 about the rocker arm shaft 20, invoked by engagement with the nose members 11, causes the first rollers 36 to move up and down relative to the chassis 19 and, more particularly, relative to first complementary rollers 40 engaged with the first rollers (see FIGS. 4 and 5).

As best shown in FIGS. 2, 3, 5, 7 and 9, a pair of legs 50 are hingedly connected to the tail portion of the actuator body 3 via respective connecting arms 52; and each connecting arm 52 has a first end pivotally coupled to the tail portion of a respective side bracket 7 via a first connector pin 54, and an opposite second end pivotally coupled to an upper part of a respective leg 50 via a second connector pin 56.

Each leg 50 has an arcuate guide slot 58 defined in a hip portion 60 of the leg. Each connecting arm 52 has an outwardly projecting guide pin 62, positioned between the first and second connector pins 54 and 56, which is slidingly received in the guide slot 58 for stably guiding the hinge mechanism 64 (comprised of the leg 50, the connecting arm 52 and the side bracket 7) between a retracted (nip closed) configuration and an extended (nip open) configuration.

Figure 8:
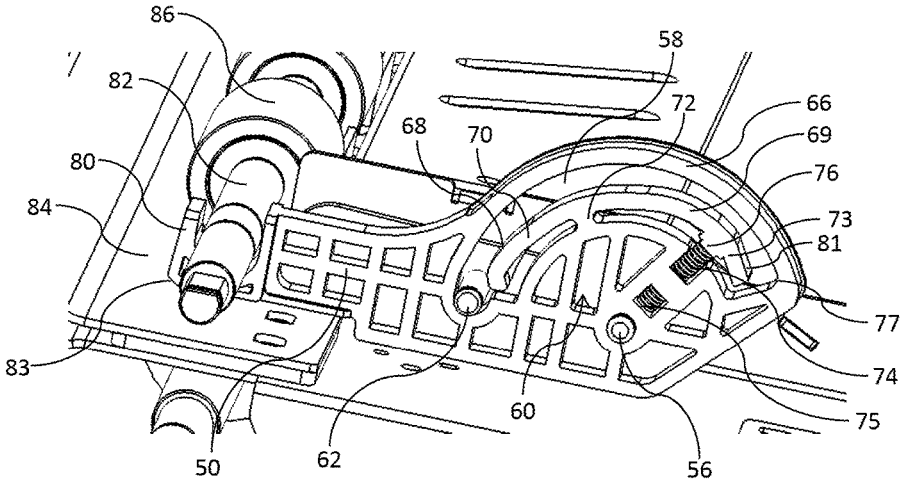
FIG. 8 is a magnified view of an opposite side of the leg and second shaft in the nip closed position.
Figure 9:
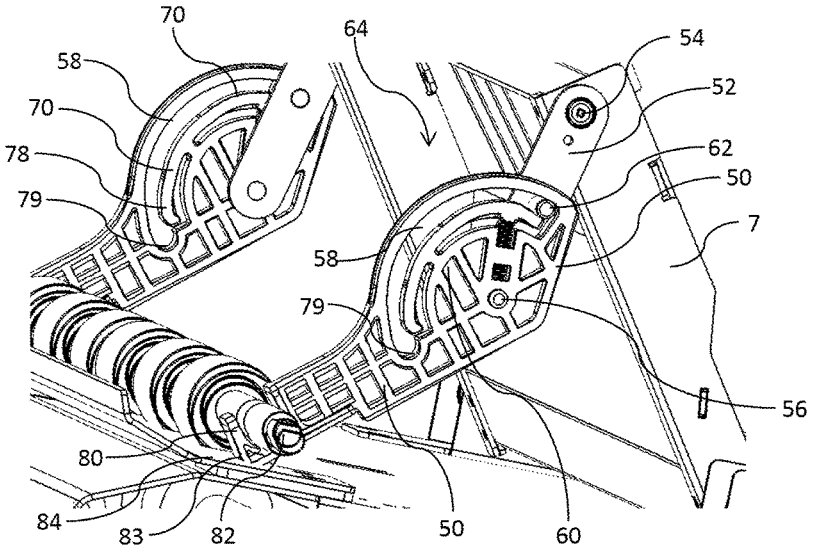
FIG. 9 is a magnified view of an opposite side of the leg and second shaft in the nip open position.

Referring to FIGS. 8 and 9, the arcuate guide slot 58 has a rigid outer guide wall 66 and a resilient inner guide wall 68. The inner guide wall 68 is comprised of first and second resilient cantilevered arms 69 and 70 mutually connected to an anchor 72 fixed to the hip portion 60 of the leg 50. The free ends of the first and second cantilevered arms 69 and 70 are resiliently biased towards the outer guide wall 66 by virtue an intrinsic stiffness of the guide wall material (e.g. metal or plastics). A first end portion 73 of the first cantilevered arm 69 is additionally biased towards the outer guide wall 66 by a spring 74 mounted between a fixed abutment surface 75 of the hip portion 60 and a spring mount 76 of the first end portion 73. As the guide pin 62 sweeps towards the first end portion 73, the spring 74 contracts and the first end portion is pushed away from the outer guide wall 66 by the guide pin. Once the guide pin 62 has swept past the spring mount region into its end-stop position 77, the spring 74 then re-expands so as to lock the hinge mechanism 64 in a fully extended configuration by means of a cam lever 81 urged against the guide pin (FIG. 9). Thus, cooperation of the guide pin 62 and the resilient first end portion 73 having the cam lever 81 provides an overcenter mechanism, which locks the hinge mechanism 64 in its fully extended (nip open) position. Similarly, a resilient second end portion 78 of the second cantilevered arm 70 locks the guide pin 62 in a home position 79 once the guide pin 62 has swept through the second end portion. Thus, the resilient second cantilevered arm 70 serves, with gravity assistance, to lock the hinge mechanism 64 in its fully retracted (nip closed) configuration (FIG. 8). Although in the embodiment shown, the second end portion 78 lacks the spring 74 of the first end portion 73, it will of course be appreciated that an additional spring may be similarly employed to assist in locking the guide pin 62 in its home position 79.

Figure 4:
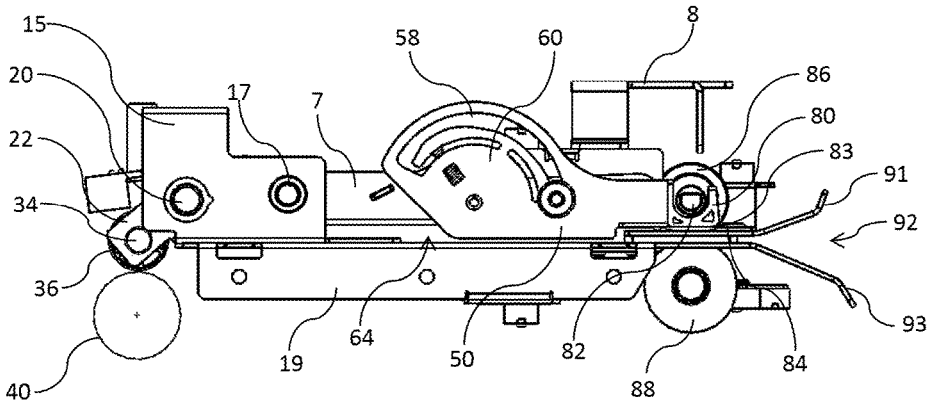
FIG. 4 is a side view of the dual nip release mechanism in the nip closed position.
Figure 5:
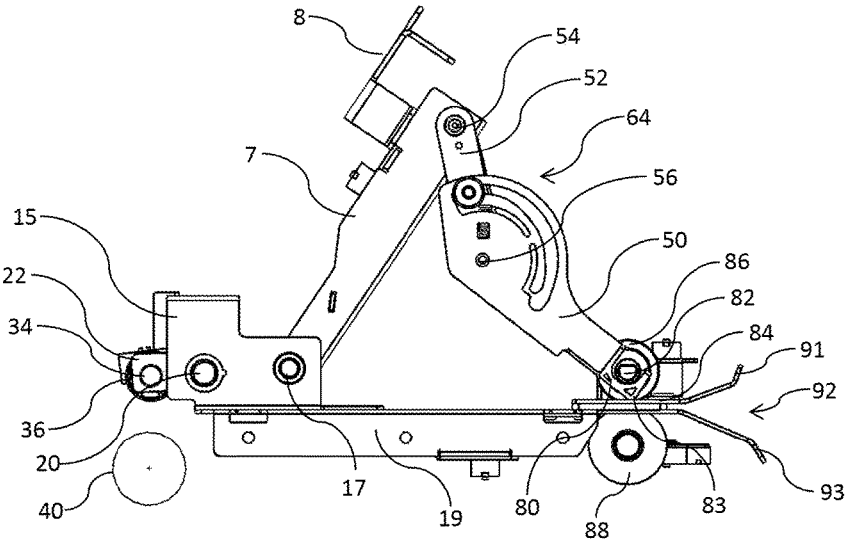
FIG. 5 is a side view of the dual nip release mechanism in the nip open position.
Figure 6:
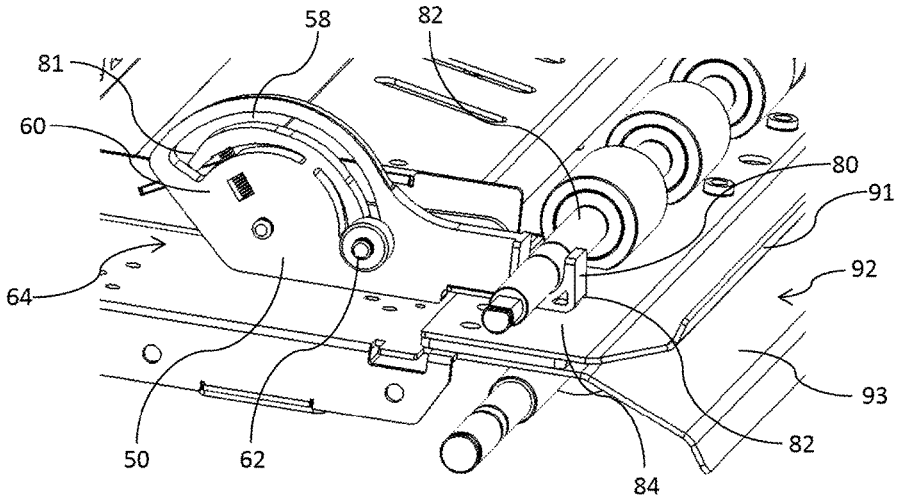
FIG. 6 is a magnified view of one side of a leg and second shaft in the nip closed position.
Figure 7:
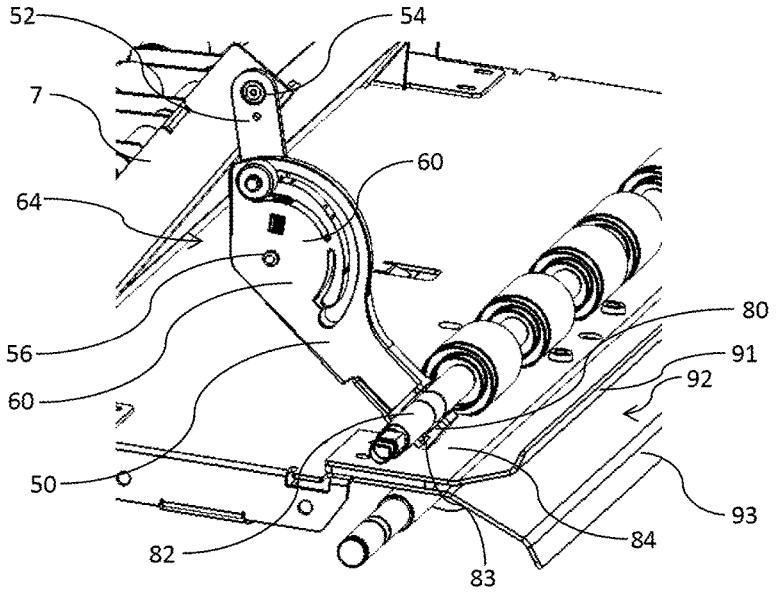
FIG. 7 is a magnified view of one side of a leg and second shaft in the nip open position.

Referring to FIGS. 4 to 9, each leg 50 has a foot 80 configured as an open-ended ("U-shaped") slot for cradling a second shaft 82. A base of each leg 50 defines a heel 83 configured for camming engagement with a fixed plate 84 attached to the chassis 19. As best shown in FIGS. 4 and 5, the second shaft 82 is cradled in the foot 80, and when the curved heel 83 is brought into camming engagement with the fixed plate 84 during extension of the hinge mechanism 64, the second shaft 82 is raised relative to the fixed plate. The U-shaped slot of the foot 80 has sufficient clearance with the second shaft 82 to enable the second shaft to be raised during movement of the leg 50.

Figure 10:
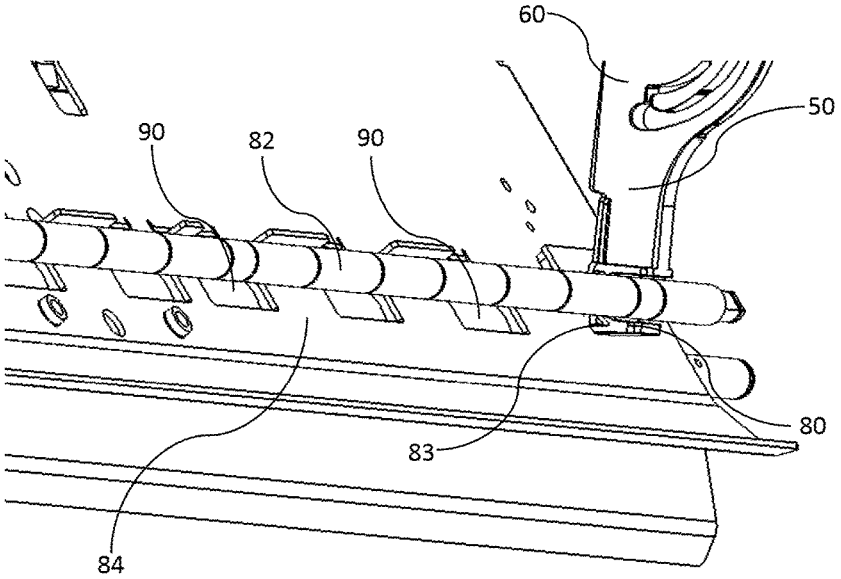
FIG. 10 is a magnified view of the second shaft and fixed plate with second rollers removed.

The second shaft 82 has a plurality of second rollers 86 rotatably mounted thereto and, in the nip closed position, each second roller is engaged with a respective second complementary roller 88 via openings 90 defined in the fixed plate (FIG. 10). When the second shaft 82 is raised via the camming engagement of the heel 83 with the fixed plate 84, the second rollers 86 are correspondingly raised relative to the second complementary rollers 88 into the nip open position (FIG. 5).

As best shown in FIGS. 4 to 7, the fixed plate 84 extends upstream along a media feed path to form an upper lip portion 91 of a flared entry mouth 92. The entry mouth 92 additionally comprises a lower lip portion 93, which cooperates with the upper lip portion 91 to direct sheets of print media into a second nip 94 defined between the second rollers 86 and the second complementary rollers 88.

Figure 13:
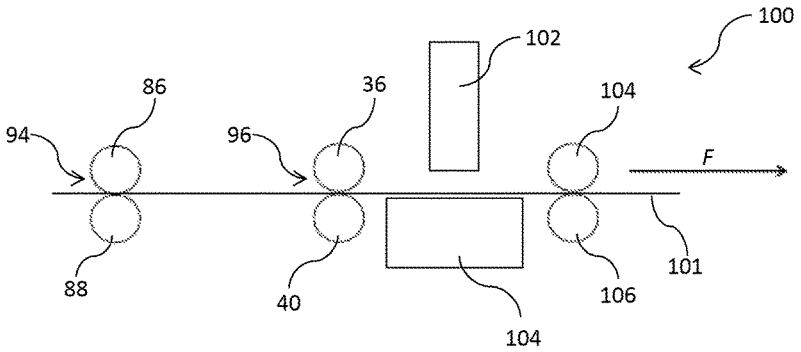
FIG. 13 is a schematic view of a printer having dual upstream roller assemblies.

Referring to the schematic printer 100 shown in FIG. 13, a printhead 102 is positioned over a platen 104 for printing onto sheets of print media 101 (e.g. paper) fed along a media feed path in the media feed direction indicated by arrow F. The second nip 94 defined between the second rollers 86 and second complementary rollers 88 is furthest upstream of the printhead 102, while the first nip 96 defined between the first rollers 36 and the first complementary rollers 40 is upstream but relatively nearer the printhead. Output rollers 104 and 106 are positioned downstream of the printhead 102. By way of example, the second nip 94 may be configured for de-skewing sheets of print media, while the first nip 96 may be configured for driving sheets of print media at constant speed past the printhead 102.

During printing, sheets of print media 101 are typically picked from a stack of sheets (not shown) and fed into the second nip 94 through the entry mouth 92 (not shown in FIG. 13). Each sheet is then fed into the first nip 96, driven past the printhead 102 and exits from the printer via the output rollers 104 and 106. During any sheet-fed printing process, but especially during high-speed printing, there is a risk of media sheets becoming jammed as they are handed off between the various roller assemblies along the media feed path.

In the event of a paper jam upstream of the printhead 102, the dual nip release mechanism 1 is used to open the first nip 96 and second nip 94 simultaneously. Initially, the printer housing is opened by the user and the handle 8 located. Lifting of the handle 8 extends the hinge mechanism 64 as described above, thereby causing the first and second nips 96 and 94 to open via pivoting of the rocker arms 22 and simultaneous camming engagement of the heel 83 with the fixed plate 84. With both nips opened, jammed paper may be readily pulled from the printer 100 by the user. Finally, once the paper has been released, the handle 8 is lowered, which retracts the hinge mechanism 64, and thereby causes the first and second nips 96 and 94 to close. Typically, the first and second shafts 34 and 82 are biased towards their nip closed positions via suitable biasing mechanisms, which control nip forces in the first and second nips 96 and 94. For example, each of the first and second shafts 34 and 82 may be engaged with a spring mechanism (not shown) for controlling respective nip forces. Alternatively or additionally, a spring mechanism (not shown) may be engaged with the proximal end of the rocker arm 22 for biasing the rocker arm towards the nip closed position.

It will, of course, be appreciated that the present invention has been described by way of example only and that modifications of detail may be made within the scope of the invention, which is defined in the accompanying claims.

The invention claimed is:

1. A dual nip release mechanism for a printer, said printer having first and second shafts engaged with respective complementary shafts to define dual nips, the dual nip release mechanism comprising:

a rigid actuator body including a tail portion having a handle for user actuation and a pivotally-mounted head portion having a nose member extending therefrom;

a rocker arm pivotally mounted about a rocker arm shaft, the rocker arm having a proximal end for engagement with part of the nose member and a distal end engaged with the first shaft; and one or more legs hingedly connected to the tail portion, each leg having a foot engaged with the second shaft and a heel for camming engagement with a fixed plate, wherein, during use, actuation of the handle causes simultaneous movement of the first and second shafts from a nip closed position to a nip open position via pivoting of the rocker arm and simultaneous camming engagement of the heel with the fixed plate.

2. The dual nip release mechanism of claim 1, wherein each foot is configured for cradling the second shaft.

3. The dual nip release mechanism of claim 1, wherein each leg is hingedly connected to the tail portion via a connecting arm.

4. The dual nip release mechanism of claim 3, wherein the connecting arm has a first end pivotally coupled to the tail portion and a second end pivotally coupled to a respective leg.

5. The dual nip release mechanism of claim 4, wherein each leg has a hip portion defining an arcuate guide slot and each connecting arm has a fixed guide pin projecting outwardly therefrom, each guide pin being slidingly received in a respective guide slot.

6. The dual nip release mechanism of claim 5, wherein the guide pin and guide slot together define an overcenter mechanism for locking the dual nip release mechanism in a nip open position.

7. The dual nip release mechanism of claim 6, wherein each guide slot has an inner guide wall and an outer guide wall, the inner guide wall having a resilient first end portion for locking the guide pin in the nip open position.

8. The dual nip release mechanism of claim 7, wherein the first end portion includes a cam lever for locking the guide pin in the nip open position.

9. The dual nip release mechanism of claim 8, wherein the hip portion comprises a spring for urging the cam lever against the guide pin.

10. The dual nip release mechanism of claim 7, wherein the inner guide wall has an opposite resilient second end portion for locking the guide pin in a nip closed position.

11. The dual nip release mechanism of claim 1, wherein the second shaft is biased towards a complementary second shaft.

12. The dual nip release mechanism of claim 1, wherein the second shaft comprises one or more rotatable second rollers, each second roller having an associated nip in the nip closed position.

13. The dual nip release mechanism of claim 1, wherein the proximal end of the rocker arm comprises a cam follower surface for camming engagement with a cam surface of the nose member.

14. The dual nip release mechanism of claim 1, wherein the first shaft is rotatably received within one or more bearings at the distal end of the rocker arm.

15. The dual nip release mechanism of claim 1, wherein the rocker arm is biased towards the nip closed position.

16. The dual nip release mechanism of claim 1 comprising a plurality of rocker arms, wherein the head portion comprises a plurality of nose members and each rocker arm is engagable with at least one respective nose member.

17. The dual nip release mechanism of claim 1, wherein the first shaft is part of a drive roller assembly and the second shaft is part of a de-skew roller assembly.

18. The dual nip mechanism of claim 1, wherein upwards movement of the handle causes upwards movement of the first and second shafts from a nip closed position to a nip open position.

19. A printer comprising:

a first shaft engaged with a complementary first shaft to define a first nip;

a second shaft engaged with a complementary second shaft to define a second nip; and a dual nip release mechanism for opening and closing the first and second nips, the dual nip release mechanism comprising:

a rigid actuator body including a tail portion having a handle for user actuation and a pivotally-mounted head portion having a nose member extending therefrom;

a rocker arm pivotally mounted about a rocker arm shaft, the rocker arm having a proximal end for engagement with part of the nose member and a distal end engaged with the first shaft; and one or more legs hingedly connected to the tail portion, each leg having a foot engaged with the second shaft and a heel for camming engagement with a fixed plate, wherein, during use, actuation of the handle causes simultaneous movement of the first and second shafts from a nip closed position to a nip open position via pivoting of the rocker arm and simultaneous camming engagement of the heel with the fixed plate.

* * * * *